United States Patent [19]

Hirvensalo et al.

[11] Patent Number: 4,967,488

[45] Date of Patent: Nov. 6, 1990

[54] METHOD OF HANDLING BALED GOODS AND A CONTAINER AS WELL AS DRYING PLANT FOR CARRYING OUT THE METHOD

[76] Inventors: Veikko A. Hirvensalo; Jaakko Y. Hirvensalo; Erkki O. Y. Hirvensalo, all of Nevas gard, 01150 Soderkulla, Finland

[21] Appl. No.: 383,227

[22] Filed: Jul. 19, 1989

Related U.S. Application Data

[63] Continuation of Ser. No. 107,479, Oct. 13, 1987, abandoned.

[51] Int. Cl.[5] ..... F26B 19/00

[52] U.S. Cl. ..... 34/90; 34/204; 34/195

[58] Field of Search ..... 34/204, 209, 210, 211, 34/218, 233, 38, 90, 192, 194, 195, 196, 197; 432/500

[56] References Cited

U.S. PATENT DOCUMENTS 4,136,465 1/1979 Wilson ..... 34/210

4,520,579 6/1985 De-Cloet et al. ..... 34/204

*Primary Examiner*—Henry A. Bennet

*Attorney, Agent, or Firm*—Mason, Fenwick & Lawrence

[57] ABSTRACT

The invention relates to a method of picking up, carrying, drying and dry-keeping baled goods, and to a container as well as to a structure replacing a drying-house for carrying out the method. The most important application is the production of dry hay, which is effected by loading the hay bales in containers (1) to be ready for drying, said containers being provided with a meshed floor, high solid walls and removable roof. A structure replacing a drying-house is set up by mounting such loaded containers upon drying-air blowing gutters and, after drying or after temporary storage at the producer's, the same containers together with dried bales are carried to consumers to serve as covered storage spaces from which baled goods is gradually picked up for use. This is to eliminate expensive drying and storage buildings, to ensure high quality for dry hay, and to minimize unloading and loading.

5 Claims, 11 Drawing Sheets

METHOD OF HANDLING BALED GOODS AND A CONTAINER AS WELL AS DRYING PLANT FOR CARRYING OUT THE METHOD

This application is a continuation of application Ser. No. 107,479, filed 10/13/87 now abandoned.

The present invention relates to a method of picking up, carrying, drying and dry-keeping baled goods, wherein the bales are collected in containers which are carried by transport wagons to a drying plant whereat the containers are placed in drying-air blowing means, whereby air is blown through the partially open container floors and bales and after drying the baled goods are carried in the same containers to consumers.

The invention relates also to a baled goods transport, drying and storage container for carrying out the method.

The invention relates further to a structure, assembled from the containers and replacing a drying-house and intended for carrying out a drying step in the method.

The most important application of the method of this invention is the production of dry hay but the method can also be applied to the handling of straw bales, drying chip bales and the like baled goods.

Hay making and production as well as transportation and storage of dry hay have always required a lot of work and labour. At present, attempts have been made to simplify hay making by allowing mowed hay to dry on the ground. From time to time hay is turned over and ruffled. In dry weather this type of drying may be successful but the method is highly dependent on weather conditions and, thus, the hay making results are very uncertain.

After a few days, the mowed hay can also be picked up as bales and dried in a drying plant, comprising a special drying-house and drying-air blowing means. On smaller farms, however, building such drying-house is uneconomical and, furthermore, the operating costs of a drying house especially in rainy summers are quite high and the outcome is uncertain. The hay bales are made up of relatively fresh hay so their moisture content and throw weight are considerable. Handling of such hay bales (loading and unloading) requires major labour input.

Finish Patent application No. 841706 discloses a grain carrying and drying system which can also be used for the carrying and drying of bales. In this prior art method, the goods to be dried is collected on transport decks carried by transport wagons to a drying plant, wherein the decks are removed and placed in drying-air blowing means for blowing air through partially openable deck bottom structures. After drying, the goods is carried on the decks to a store for consumers. The openable and closeable bottom structure and relatively low sides of such decks mainly serve for grain drying purpose, although drying of bales is also plausible. However, a drawback involved in the application of this prior art system is that, in addition to relatively expensive deck or platform structures, the system requires a large and expensive drying-house and, furthermore, the consumer needs average buildings for dried bales for unloading dried bales therein for storage. Also the producer needs separate store rooms as a drying-house is too expensive to be used as a store room. Thus, the decks used in this prior art system are only suitable for carrying and drying but are neither intended nor suitable for storing baled goods over the various stages of its handling and use. This is why this prior art system has not been applied in practice to the production of dry hay.

An object of the invention is to provide a method, whereby high-quality dry hay can be produced economically in bales even in rainy growing seasons and by which method it is economically worth while to dry hay grown even in small farming areas in a drying plant, which is a major improvement to the quality of hay.

A second object of the invention is to provide a method, whereby the handling of bales (loading and unloading) remains less than in any other known method. In other words, when bales have been loaded in containers according to the invention, as required by the drying process, it is no longer necessary to unload or load them but, instead, the consumer picks up the bales from containers to direct use.

A particular object of the invention is to provide a method which eliminates the need for presently used drying-houses or storage buildings, which a substantial saving in costs for both the producer, consumer and user.

These objectives are achieved by the application of a method of the invention, which is characterized in that the walls and roof of a structure replacing the drying-house are built by laying containers with weather proof, high solid walls side by side and/or on top of each other and by providing the containers or the top containers of superimposed container layers with a roof which provides an exit for drying all blown through the containers and that, after drying and possible temporary storage at the producer's, the same containers are carried together with dried bales to the consumers as covered storage rooms from which the dried baled goods is gradually used.

One particular application of this method is characterized in that the method is used for the production and storage of dry hay without permanent drying or storage buildings, by means of transport, drying and storage containers. The automobile bodies presently required can also be eliminated and the transportation is effected by means of regular pick-up trucks.

A transport, drying and storage container for baled goods intended for carrying out the method is characterized in that a container, fitted with a perforated or wire-meshed floor and high solid walls, is provided with fastening means for preferably removable fastening of a roof or cover and that the roof is provided with a ventilation hole for letting air out of the container.

The considerable height of such solid container walls, the height preferably exceeding the floor width, the meshed floor and the possibility of fastening a roof provided with an air-discharge port, all make it possible that the container can be used in all following steps of handling hay bales:

- pick-up from the field and short-term storage prior to transport to drying plant
- transport to drying plant
- building the walls and roof of a structure replacing the drying-house by laying containers side by side and/or on top of each other
- drying process by blowing air through containers mainly from below upwards
- after drying, storage at the producer's
- transport from producer to consumer by pick-up trucks or wagons service as a consumer's storage from which bales are put to use.

An essential point in the above handling steps is that, once the bales are loaded in containers from the field, they shall not be touched, unloaded or loaded anymore until a consumer starts using them directly out of containers.

Another essential novelty in the invention is that the containers themselves are weather-resistant and ventilated so as to provide a drying and storage space, so the need for a drying-house, storage buildings and barns is totally eliminated.

The amounts of hay distributed in separately ventilated containers or in drying towers provided by stacked containers can be individually monitored and drying conditions can be separately adjusted, as required.

The use of a method and a container of the invention intensifies the drying process and even relatively damp hay can be made, which substantially increases the rate of hay-making and it is even possible to harvest two crops of hay annually for a substantially increased yield of hay. The fall-off losses are also less than before, which further increases the yield.

A drying structure intended for carrying out the drying step in a method of the invention is characterized in that its outer walls and roof consist of transport, drying and storage containers, laid side by side and/or on top of each other and provided with a partially open floor, solid walls and a roof on the uppermost stack of containers, said roof being provided with at least one port for providing an exit for drying air blown through the container floors.

One preferred embodiment of a container and a drying plant intended for applying the invention will now be described in more detail with reference made to the accompanying drawings, in which FIG. 1 is a general view of a drying plant of the invention, FIG. 2 is a side view of the drying plant and FIG. 3 is an end view of the same drying plant, said drying plant comprising two parallel drying lines.

In the following, the invention is described as applied to the production of dry hay. In hay-growing farms, hay is harvested as bales and fresh hay bales are loaded in containers 1. Loading can be performed either in a container placed on the fringe of a hay field by using e.g. a farm tractor and its accessories or a container can be mounted on a wagon, coupled to the end of a haybaling machine. As explained in more detail later, the container is provided with a wire-meshed floor, solid walls and fastening means for fixing a roof or a cover.

Figure 1:
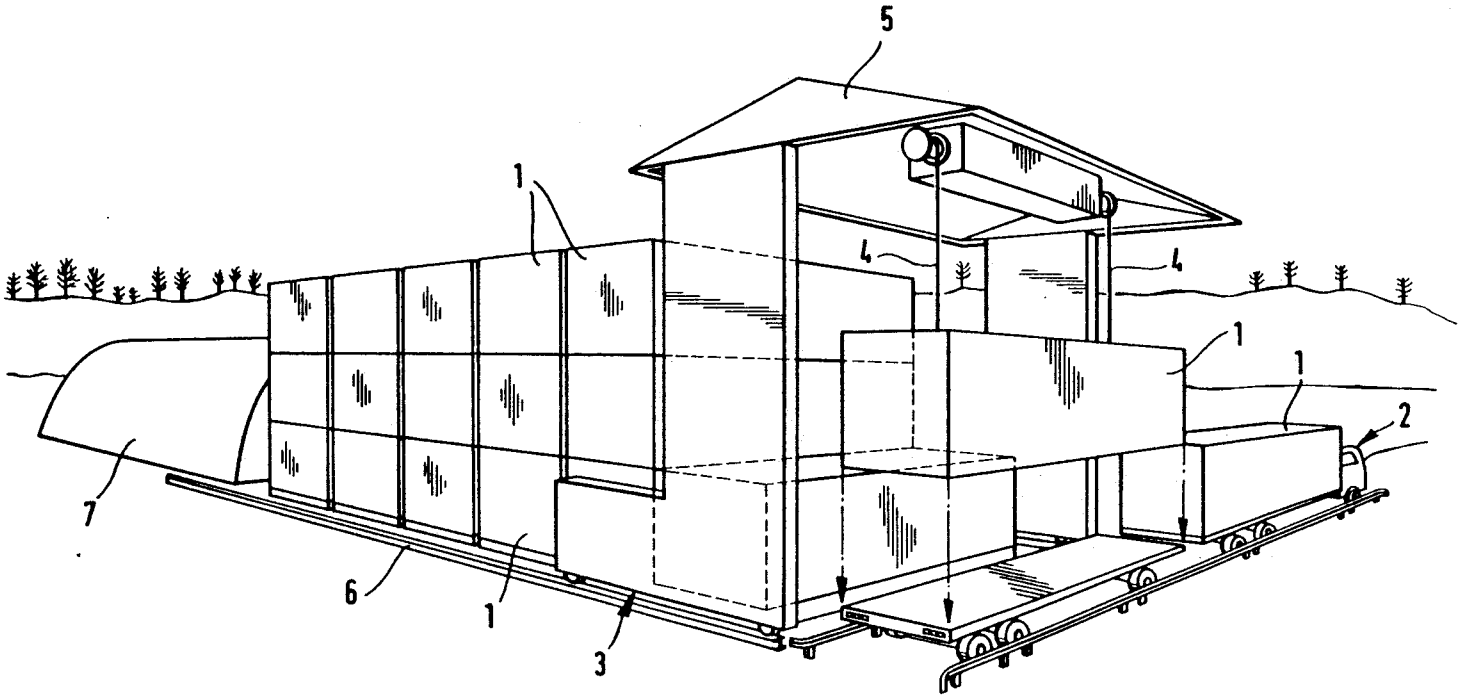
Figure 2:
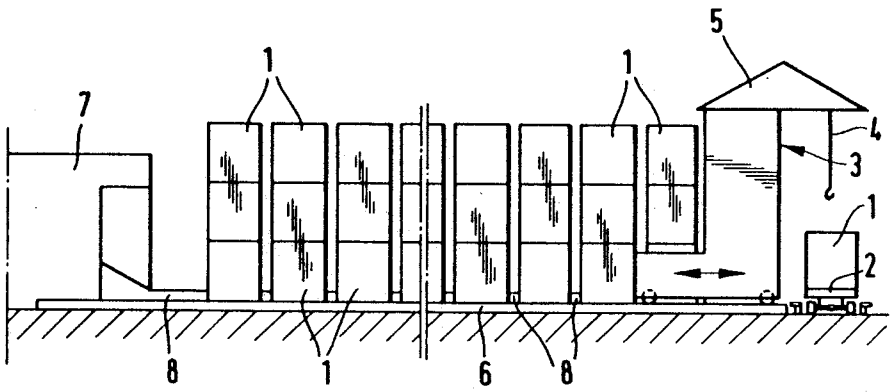
Figure 3:
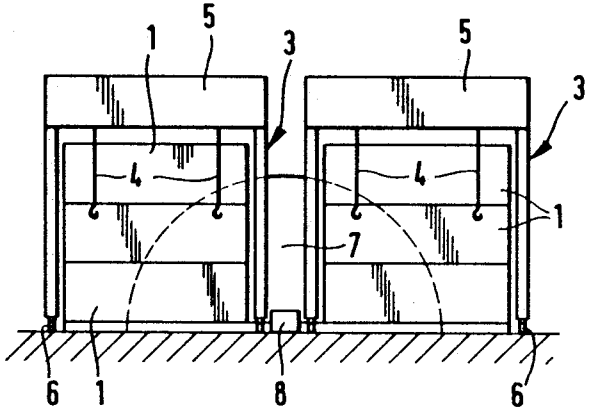

Once it is filled, a container 1 is carried by a transport vehicle 2 to a drying plant. A drying plant shown in FIGS. 1–3 comprises a gantry crane 3, movable on tracks 6, and a drying-air blower 7 which is connected by way of an air-supply duct 8 to air-blowing gutters 9 (FIG. 4), upon whose edges the lower edges of container 1 can be tightly set.

When using containers of the invention there is no need for any drying-house but, instead, a structure replacing the drying-house is built by laying containers 1 side by side and/or on top of each other upon blowing gutters 9. This is done by means of a crane 3, whose height is sufficient for stacking containers in at least two superimposed layers. The pick-up and transfer of containers is effected upon cables 4. The crane is also provided with a rain shelter 5 which travels along with the crane. Thus, containers can be carried to a drying plant and from drying plant to a producer's storage depot also in rainy weather even if this transfer would involve the replacement of a roof or a deck covering the containers.

As described in more detail later, the wall structure of containers is sufficiently sturdy so as to stack containers on top of each other without other supporting structures. As the edges of stacked containers fit tightly against each other, the containers, by virtue of their wire-meshed floors, provide a drying tower from whose bottom end the drying air is blown through hay material.

Figure 4:
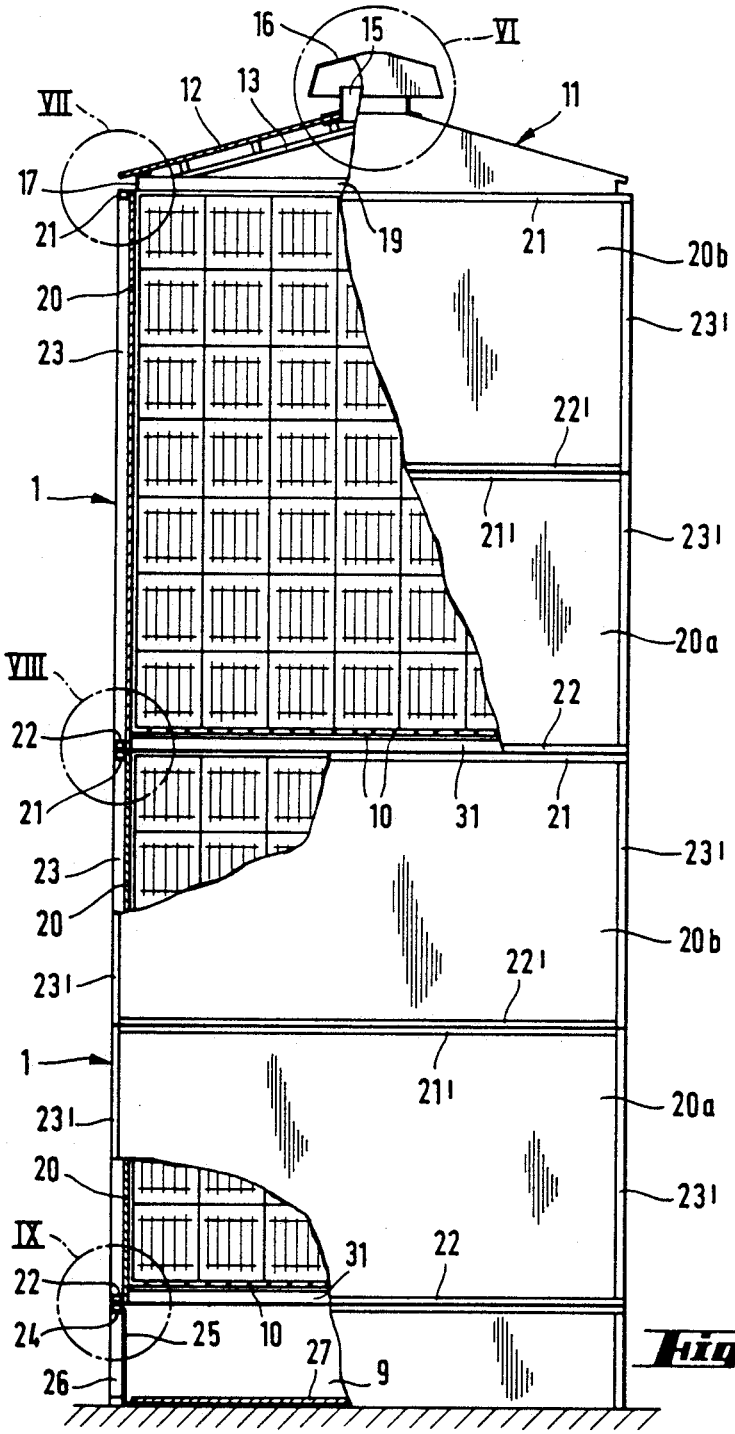
FIG. 4 shows two superimposed containers partially cut away and placed on top of a blowing gutter, the viewing direction being from the end of containers or from the side of a drying plant.
Figure 5:
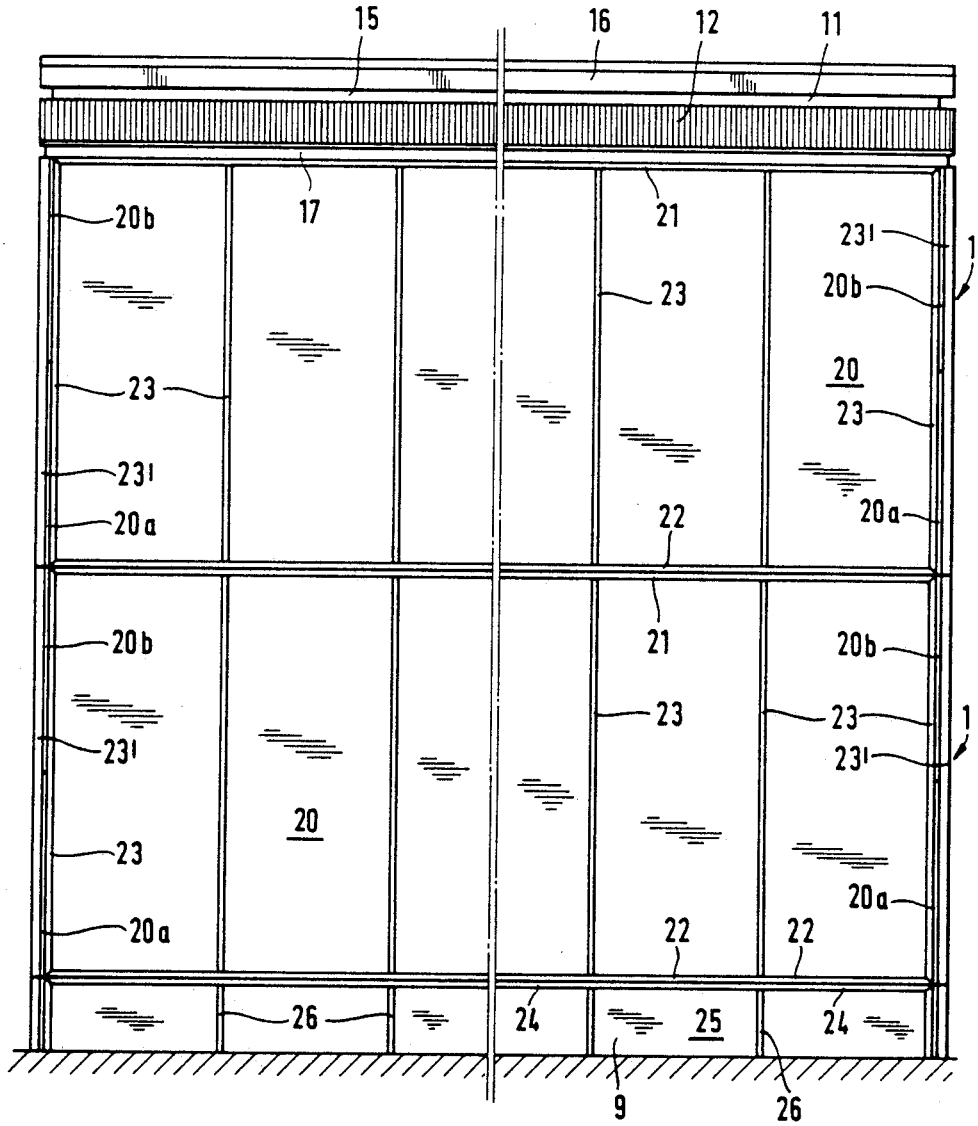
FIG. 5 shows the same as FIG. 4 in a side view.

As shown in FIGS. 4 and 5, the top container of a drying tower provided by containers stacked on top of the blowing gutter 9 is fitted with a roof 11. While required to prevent water from entering the drying tower, the roof must also provide an exit for the drying air blown from gutter 9 through the containers. Therefore, as shown in more detail in FIG. 6, the roof top portion is provided with a ventialtion port 15, which is of the same length as the container and provided with electroplated sheet metal walls 14 which join a roofing surface 12, made e.g. of profiled sheet metal. The port 15 is covered with a cap 16 that can be lowered down when drying is completed. Ventialtion port 15 is larger than the inlet port of said blowing gutter so as not to create counter-pressure. Reference numeral 13 refers to roof support pipes.

Figure 7:
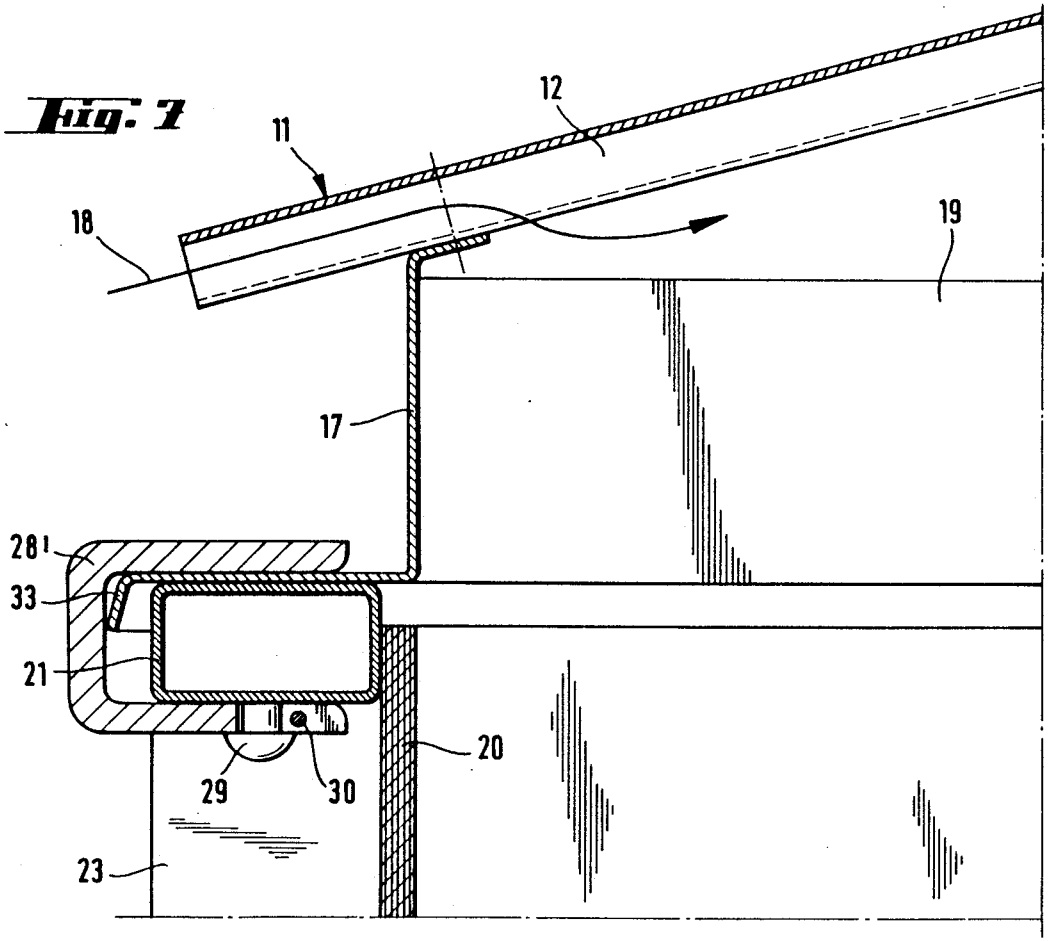

FIG. 7 shows the attachment of a roof edge to the top edge of a container wall. A roofing material 12 is fastened e.g. by riveting to a skirting 17 of electroplated sheet metal. Between skirting 17 and roofing 12 remain the air-circulation ports provided by the profiles of said roofing for admitting air therethrough, as indicated by an arrow 18. This natural air circulation prevents the formation of condensation water on the bottom surface of a roof during storage.

Figure 6:
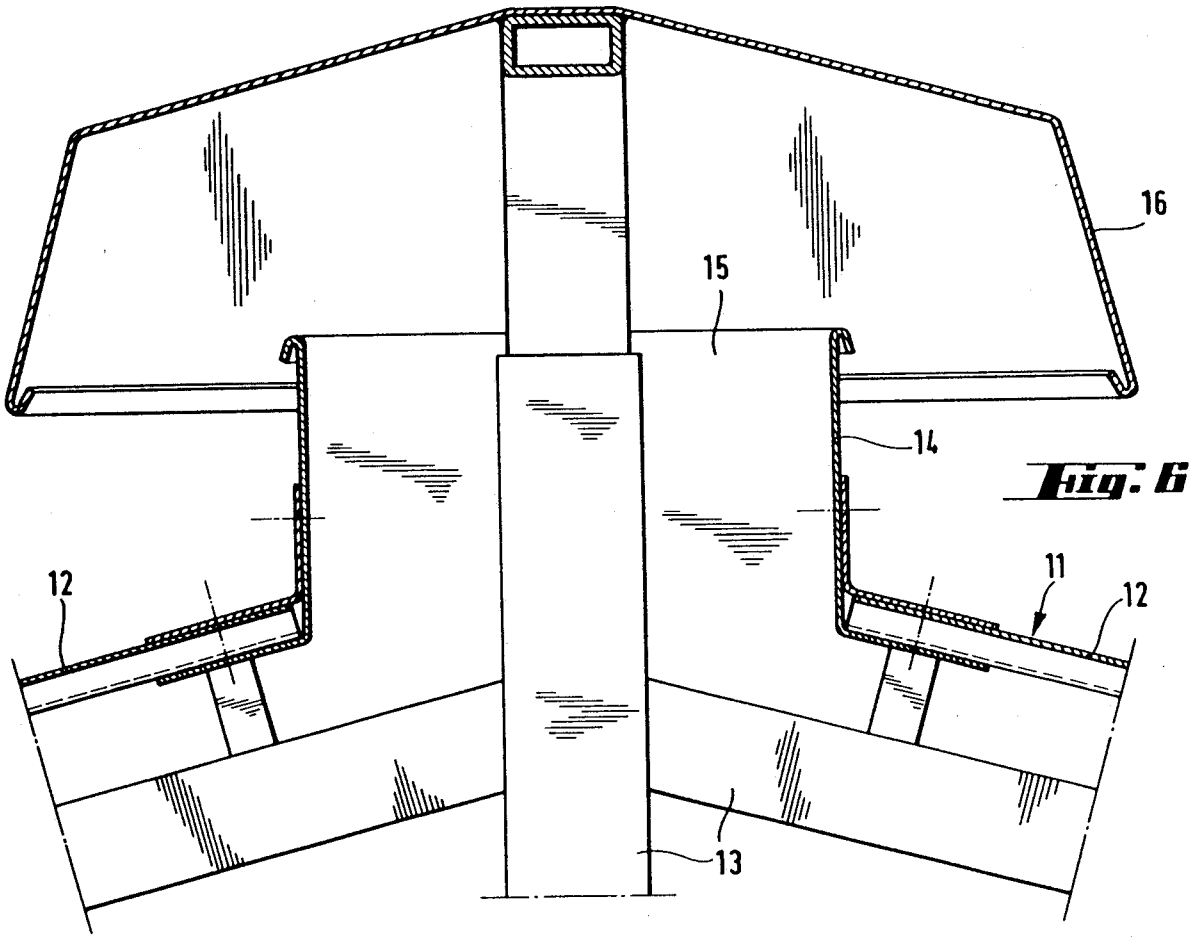
FIGS. 6–9 show structural details of a container at points VI—IX in FIG. 4.

Skirting 17 is fixed to the ends of horizontal girders 19. The support pipes 13 shown in FIG. 6 are attached to girders 19.

The outer surface of the top end of e.g. a plywood-made wall board 20 is provided with a fixed horizontal tubular beam 21, resting upon vertical tubular beams 26. Skirting 17 rests upon tubular beam 21 and is secured in position by means of U-shaped clamping means 28'. The bottom surface of beam 21 is fitted with a rivet, a screw or a similar studlike fastening member 29, a runner corresponding thereto being made in the lower branch of U-clamp 28'. A locking pin 30 can be used to prevent loosening of U-clamp 28'. The same fastening rivet 29 can also be used for fixing a tarpaulin serving as a cover, as explained later.

The outer edge of skirting 17 is designed as a drip strip 33.

Figure 8:
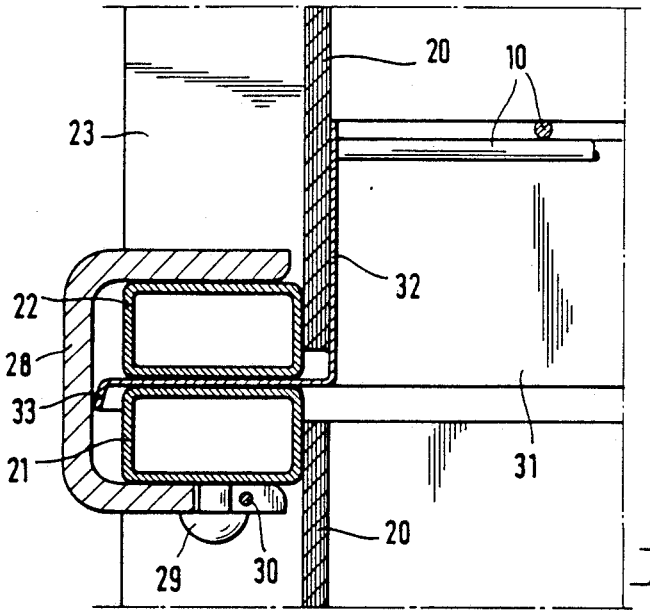

FIG. 8 shows the linking between two containers. A tubular beam 21 at the top outer edge of the lower container and a tubular beam 22 at the bottom outer edge of the upper container are locked against each other by means of a U-shaped fastening clamp 28, fixed in position by means of a rivet 29 and a lock pin 30. Inside a wall plywood 20 is mounted a skirting 32, whose horizontal section extends through the junction between the container edges and whose outer edge is provided with a drip strip 33. The upright section of skirting 32 is secured to the ends of transverse container floor girders 31. A wire-meshed floor 10 rests upon girders 31. The ends of upright support pipes 23 are secured to beams 21 and 22.

Figure 9:
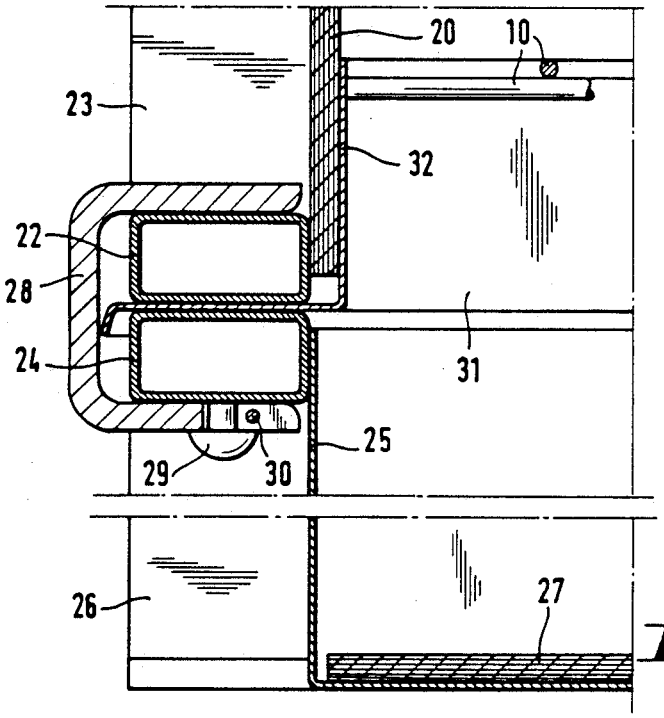

FIG. 9 shows how the outer edge of the lower container is tightly set upon the top edge of a blowing gutter 9. A horizontal support beam 24 serving as the top edge of a blowing gutter is fastened to a blowing gutter wall board 25 and, furthermore, rests upon upright support pipes 26. The floor of a blowing gutter can be made of a plywood board 27. Side beams 22 and 24 are locked together the same way as the container edges in FIG. 8.

Figure 10:
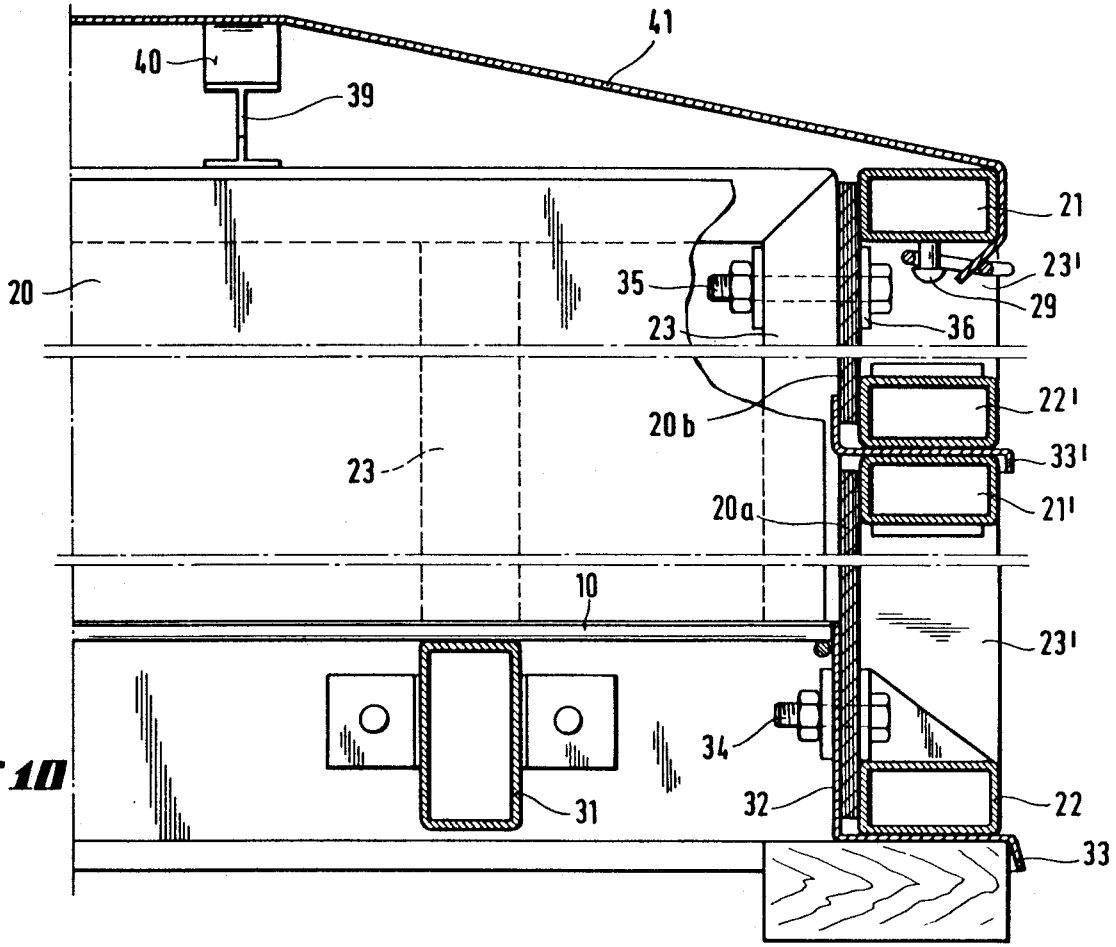
FIG. 10 is a vertical section of a container gable design.

FIG. 10 illustrates the structure of a container end wall. The end wall is made of two or more superimposed sections **20*a* and 20*b*, whereby the lower one can be installed at a certain stage of loading and the upper one only when loading is completed. Linking the opposing edges of wall sections 20*a* and 20*b* is effected on the same principle as the linking between container walls. In other words, horizontal beams 21' and 22' are placed on top of each other and a skirting with its drip strip 33' extends from between them. Between the horizontal beams there are vertical beams 23'. The lowermost horizontal beam 22 is secured to a wall board 20*a* and a skirting 32 by means of a fastening bolt 34. A similar bolt mounting can be used all around a container for fastening a lower beam 22, a wall board 20 and a skirting 32 (see e.g. FIG. 12, bolt 34**). The wall plywood is secured to the wall frames by rivets, screws, glueing or a like method.

Figure 11:
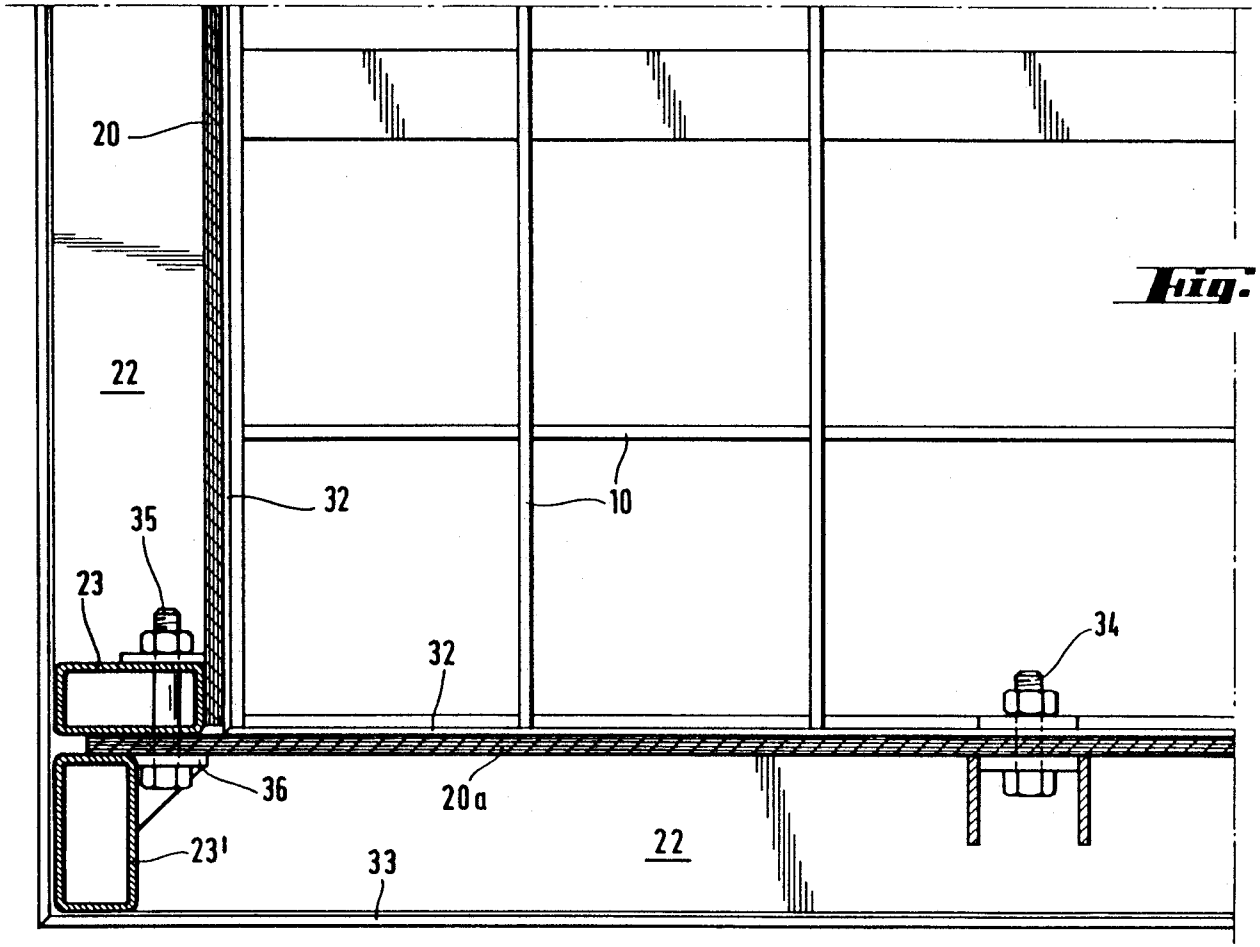
FIG. 11 is a horizontal section of a container corner design.

The separate side and end walls of a container are assembled by means of bolted joints at the corners, as shown particularly in FIG. 11. A fastening bolt 35 extends through a mounting bracket 36 and a vertical beam 23. Bracket 36 is welded to a vertical end wall beam 23' while said vertical beam 23, through which bolt 35 extends, provides the vertical edge for a side wall (see also FIG. 10).

Figure 12:
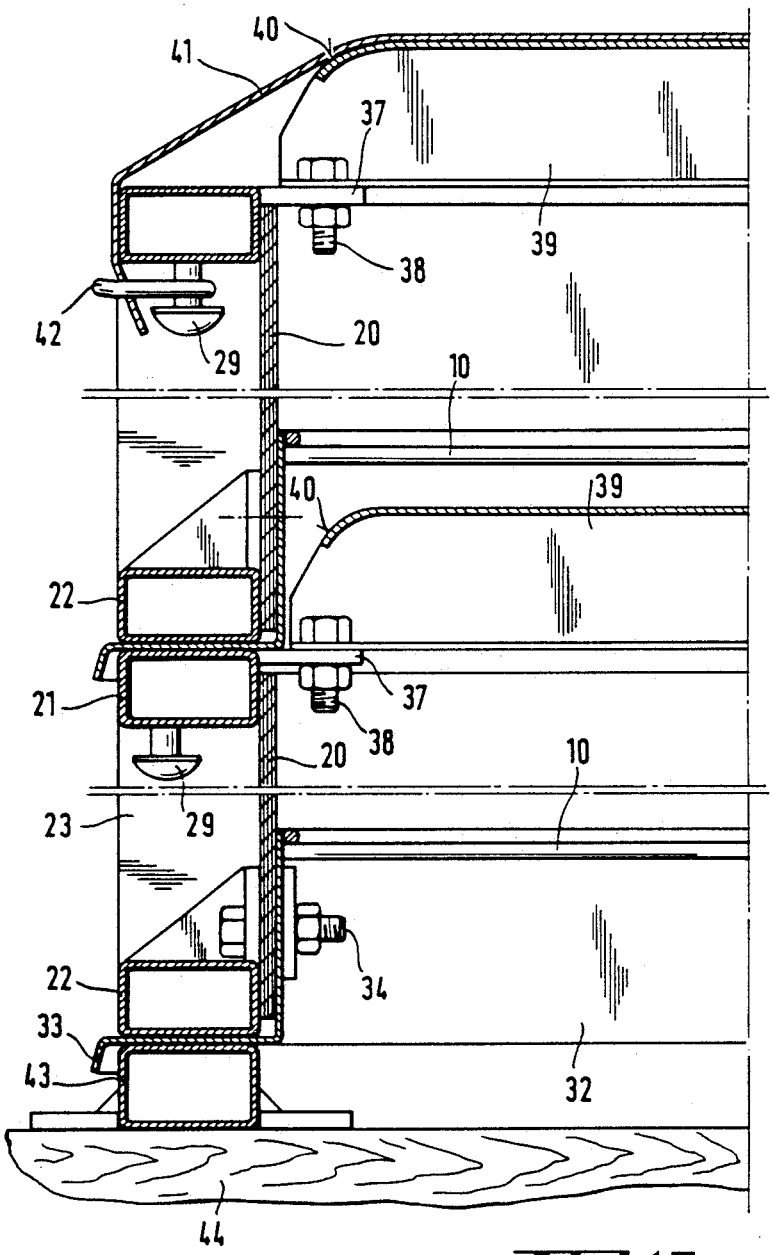
FIG. 12 is a vertical section of the design of a container side wall the same way as FIGS. 8 and 9, but sectioned at different points for illustrating different details.

FIG. 12 shows brackets 37 secured to top edge beams 21 of the containers, whereby transverse support girders 39 are fastened to said brackets by bolts 38 for preventing the side walls from expanding outwards under the pressure caused by the goods loaded in containers. Another object of girders 39 is to use their bevelled ends 40 as alignment guides for the bottom edge of the upper container as containers are laid on top of each other. For this reason, girders 39 are at least partially positioned above the top edge of a container (top surface of beam 21). A third object of girders 39 is to serve as supports for a not self-supporting roof structure, such as a tarpaulin 41 that has anchoring links 42 at its edges for securing it to fastening rivets 29. In FIG. 12, the bottom edge of a stack of containers is shown as placed upon a tubular beam 43. The other edge is supported the same way upon a tubular beam and these tubular beams 43 are placed e.g. upon railway sleepers 44. Thus, the containers are carried away from above the blowing gutters of a drying plant for storing dry hay at the sites. At this time, it is no longer necessary to have a self-supporting roof 11 but, for the actual storage, it is possible to use a cheaper cover, such as a tarpaulin 41. Both producer and consumer can use the containers for storing dry hay. When the containers have been converted into a consumer's storage spaces e.g. in early spring, the blowing gutters of a drying plant must be protected from above with a roof the same way as containers. Thus, said roofs 11 can be mounted directly upon the edges 24 of a blowing gutter 9 by means of the same fastening means 17, 28' as those used for mounting it upon the edges of a container.

Figure 13:
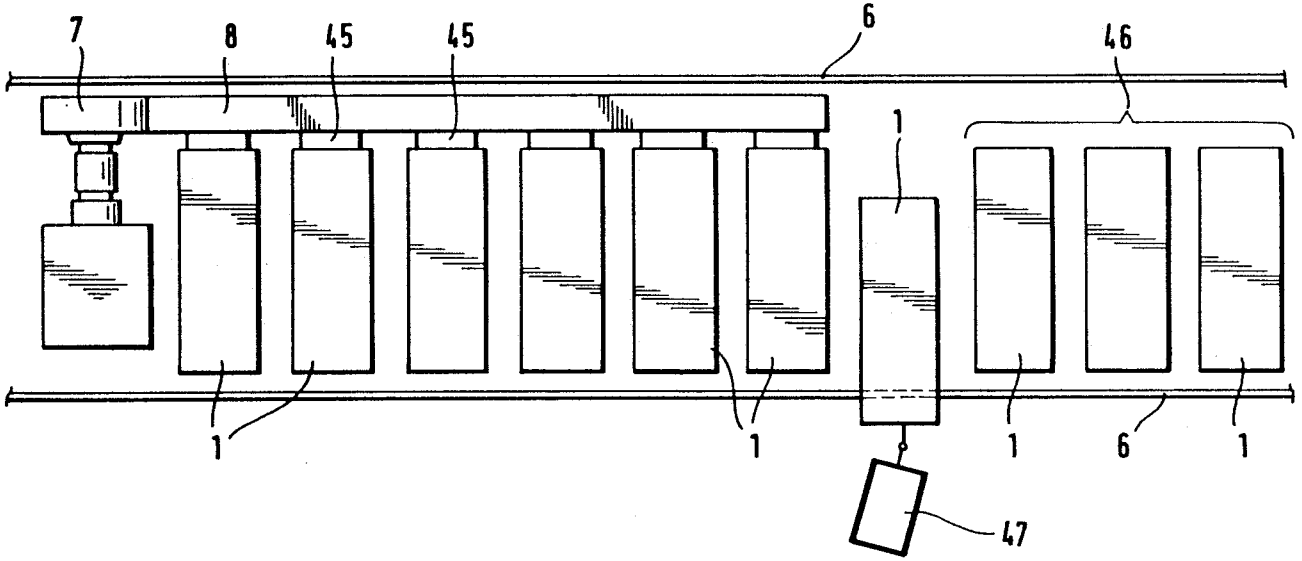
FIG. 13 shows a layout for a drying plant according to another embodiment.

FIG. 13 shows the layout of a single-line drying plant set-up in which a blower 7, driven e.g. by a tractor, is used to blow drying air by way of a supply duct 8 into blowing gutters below containers 1. Between supply duct 8 and blowing gutters there are air heaters 45, whose heating effect and/or on/off switching is individually controllable. This facilitates the drying of amounts of hay having different moisture contents and it is also possible to start the drying of amounts of hay brought to a drying plant at different times immediately, regardless of other amounts of hay. Of course, it is possible to heat blowing air in a centralized manner by means of a single heater fitted in supply duct 8 and the drying effect is regulated by controlling air distribution between different blowing gutters.

In FIG. 13, a producer's storage is also set up in connection with a drying plant by extending crane tracks 6 beyond the drying gutter area. Thus, all that is needed in this storage area 46 are support beams 43, 44 shown in FIG. 12. Bringing the containers into a drying plant and out of a storage can be done by way of the passage between drying area and storage area 46. Transportation of containers can be effected e.g. by means of separate wagons, pulled by a tractor 47.

The length of containers is e.g. 9 m. In some cases, however, this length may lead to transport difficulties (sufficient turning space not always available). Therefore, the containers can be designed to be disconnected at mid-length and to be re-connected e.g. on the same principle as the connections between the containers laid on top of each other. At a drying plant, such container halves are connected to full length prior to lifting them up on drying equipment.

It is obvious that the possibilities of carrying out the invention are not limited to the structural details set out in the above embodiments, as such details may vary in many ways within the scope of the annexed claims. For example, it is possible to provide the containers with permanent roofs that are falling from sides to centre and from centre to ends, whereby the containers can be laid on top of each other despite the roof. Air-circulation ports can then be arranged below the roof edges. In small-scale production, where stacking of containers is not needed, even a peak roof can be permanent and be carried along with a container. The container walls can also be provided with small air-circulation ports, protected against rain water. With a large number of containers, the possibility of removing the roof serves the purpose that only the top container in a stack of containers need be provided with a roof and a self-supporting roof with ventilation ports is only needed at a drying plant while, in storage use, the dried baled goods can be protected by using a tarpaulin cover. This reduces structural costs. In addition, the possibility of removing a roof offers the advantage that the overhead loading of bales is possible by using lifting equipment.

We claim:

1. A method of picking up, carrying, drying and dry-keeping hay or straw goods, wherein said goods are collected in containers to be carried on transport vehicles to a drying plant whereat drying-air is to be blown through the partially open container floors and said goods and, after drying, said goods are carried in the same containers to consumers, each container having vertical side walls and partially open containers floors, comprising the steps of arranging the containers in a plurality of vertically stacked plural container tiers with the side walls and a roof therefor forming a structure replacing a drying-house, the tiers being built by laying containers with weather-resistant, high solid walls on top of each other and by placing above the top containers of piled-up container stacks, the roof having an exit for drying air blown through the containers, and after drying and temporary storage at the producer's, carrying the same containers together with dried goods to the consumers to serve as covered storage rooms from which the dried goods is gradually used.

2. A method as set forth in claim 1, the method is applied for the production and storage of dry hay without permanent drying or storage buildings by means of carrying, drying and storage containers.

3. A plural-container structure replacing a hay or straw goods drying building for carrying out the drying step in a method of claim 1, each container having outer walls forming carrying, drying and storage containers laid on top of each other and provided with a partially open floor, said outerwalls being solid walls at all sides of the drying space, and a roof upon the top layer of containers, said roof having at least one port for providing an exit for the drying air blown through container floors.

4. A structure as set forth in claim 3, wherein several layers of containers are laid on top of each other in a manner that the top and bottom edges of piled-up containers are set tightly against each other, the piled-up containers creating a continuous drying tower.

5. A transportable storage and drying container structure for facilitating picking up, carrying, drying, and dry-keeping hay or straw goods, comprising a generally rectangular, box-like container having vertical side enclosure walls and vertical end enclosure walls joined together forming interconnected outer enclosure walls providing an enclosure barrier wall structure enclosure walls providing an enclosure barrier wall structure completely laterally surrounding a rectangular space of uniform height defining a storage and drying space for said goods, said containers being of uniform length, width and height, said outer enclosure walls having upper and lower edges and having horizontal support beams at said upper and lower edges in vertical registry, said support beams at the lower edges defining a lower support surface which can be placed resting upon said support beams at the upper edges of a like container whereby said outer enclosure walls of said containers can be placed in vertical registry resting upon outer enclosure walls of like containers of the same construction to form vertically stacked plural container tiers, a roof of a size to completely cover one of said containers to be disposed upon the uppermost edge of the outer walls of the container and having at least one port for providing an exit for drying air blown through the container, and said container having a perforate floor for supporting said goods thereon and allowing passage of drying air therethrough.

* * * * *